US005217268A

United States Patent [19]

MacCalder

[11] Patent Number: 5,217,268

[45] Date of Patent: Jun. 8, 1993

[54] DOOR SECURITY SYSTEM

[76] Inventor: John H. MacCalder, 6620 Dalcroft Hill NW, Calgary, Alberta, Canada, T3A 1N4

[21] Appl. No.: 913,012

[22] Filed: Jul. 14, 1992

Related U.S. Application Data

[63] Continuation-in-part of Ser. No. 701,887, May 17, 1991, Pat. No. 5,135,273.

[51] Int. Cl.[5] ..... E05C 17/16

[52] U.S. Cl. ..... 292/338; 292/DIG. 15

[58] Field of Search ..... 292/258, 338, 339, DIG. 60, 292/DIG. 15, 263, 63, 67

[56] References Cited

U.S. PATENT DOCUMENTS

| | | | |
|---|---|---|---|
| D. 290,579 | 6/1987 | Crisp et al. | D8/339 |
| 1,032,585 | 7/1912 | Brady | 292/339 |
| 1,044,728 | 11/1912 | Basler | 292/338 |
| 1,064,320 | 6/1913 | Glindkamp . | |
| 1,820,486 | 8/1931 | Patrick et al. . | |
| 1,847,705 | 3/1932 | Yorger . | |
| 1,985,164 | 12/1934 | Green | 292/338 |
| 2,595,709 | 5/1952 | Sands | 292/339 |
| 3,731,341 | 5/1973 | Woodruff | 16/82 |
| 4,421,348 | 12/1983 | Kahn | 292/339 |
| 4,456,291 | 6/1984 | Brogie | 292/338 |
| 4,456,921 | 6/1984 | Brogie | 292/338 |
| 4,514,000 | 4/1985 | Chezem et al. | 292/338 |
| 4,560,192 | 12/1985 | Wilson et al. | 292/339 |
| 4,607,870 | 8/1986 | Crisp et al. | 292/338 |
| 4,641,869 | 2/1987 | Johnson | 292/339 |
| 4,673,203 | 6/1987 | Chezem | 292/338 X |
| 4,674,779 | 6/1987 | Pratt | 292/263 |
| 4,822,086 | 4/1989 | Brown | 292/338 |
| 5,135,273 | 8/1992 | MacCalder | 292/338 |

*Primary Examiner*—Richard E. Moore
*Attorney, Agent, or Firm*—Robert W. B. Bailey

[57] ABSTRACT

A door security system has a floor contacting foot pivoted on a prop, itself pivoted on a locking system attached to a door support. A bracket with opposed spaced apart face walls joined by edge wall to receive a door corner may be used to attach the door support. A hand releasable locking system has saw teeth engaging saw teeth on the door support. Prop mountings on both foot and locking system restrict the floor prop angle, which may be from 60° to 70°, and conveniently 65° to 70°, especially 69°. The device may be installed permanently or temporarily, on a door, it is far more effective than a door chain. A ratchet may be incorporated to tighten the prop, and a release lever to 'break' the prop. A floor plate with a hole may be used to fix the foot to the floor by a pin passing through a similar hole in the foot.

20 Claims, 5 Drawing Sheets

DOOR SECURITY SYSTEM

This application is a continuation in part of application Ser. No. 07/701,887 filed May 17, 1991, now U.S. Pat. No. 5,135,273 issued Aug. 4, 1992.

This invention relates to door security systems. In particular it relates to door security system kits which fit on the insides of doors at their lower corners, especially inner doors.

Although the invention will be described and referred to specifically as it relates to door security system kits including support means, prop means, locking system means, and foot means, it will be understood that the principles of this invention are equally applicable to similar devices and accordingly, it will be understood that the invention is not limited to such door security system kits.

DESCRIPTION OF PRIOR ART

U.S. Pat. Nos. 1,032,585 issued Jul. 16, 1912 to Brady, 1,044,728 issued Nov. 19, 1912 to Basler, 1,064,320, issued Jun. 10, 1913, to Glindkamp, 1,820,486, issued Aug. 25, 1931, to Patrick, 1,847,705 issued Mar. 1, 1932, to Yorger, 1,985,164, issued Dec. 18, 1934 to Green, 2,595,709, issued May 6, 1952 to Sands, 3,731,341, issued May 9, 1973, to Woodruff, 4,456,291 issued Jun. 26, 1984, to Brogie, 4,514,000 issued Apr. 30, 1985, to Chezem et al., 4,673,203, issued Jun. 16, 1987, to Chezem, 4,560,192 issued Dec. 24, 1985, to Wilson et al., 4,607,870 issued Aug. 26, 1986, and U.S. Pat. No. Des. 290,579, issued Jun. 30, 1987, both to Crisp, Jr. et al., 4,641,869 issued Feb. 10, 1987, to Johnson, 4,822,086 issued Apr. 18, 1989 to Brown, all of record in the earlier United States patent application, teach various door securers, including door attachment means pivoted prop means, and foot means.

It is an object of the invention to provide an improved door security system kit, which is lockable in position. It is a further object to make the kit easily releasable. It is a subsidiary object to make it difficult to dislodge the kit once in place from outside the door. Other objects will be apparent to those skilled in the art from the following specification, appended claims and accompanying drawings.

DESCRIPTION OF THE INVENTION

In a broad aspect the invention is directed to security system kit for mounting to the inner face of a door to engage the floor to prevent the door being opened comprising in combination: support means mountable on the door, prop means pivotally mounted in the support means by locking system means, and floor contacting foot means pivotally mounted on the prop means. The improvement provides the support means comprising base wall means for mounting to the inner face of a door, and the support means includes channel means extending upward, when the base wall means is mounted on a door. The channel means including paired spaced apart opposed channel walls having facing longitudinally extending grooves therein. The locking system means comprising slide means slidably mounted in the channels means, the slide means having side flanges slidably received in the grooves, the slide means mounting releasable locking means. The channel means further including receiving means for mating engagement of the locking means, extending longitudinally of the channel means. The locking means may be provided by each channel means wall having saw tooth surfaces extending longitudinally of the walls, facing away from the door when the support means is mounted thereon. A well means within the slide means has opposed inner and outer walls, the outer wall having an aperture, shaft means slidably mounted in the aperture, block means having saw tooth surface means mounted on the shaft means, spring means in the well means in contact with the block means and the outer wall urging the saw tooth surface means into mating engagement with the saw tooth surfaces of the channel walls. Handle means attached to the shaft means, enable disengagement of the block means. Preferably the base wall means includes first lower base aperture means and second upper aperture means allowing the base wall means to be fixed attached to the door means.

In a further broad aspect the invention is directed to an improved security system kit for mounting to the inner face of a door to engage the floor to prevent the door being opened comprising in combination: support means mountable on the door, prop means pivotally mounted in the support means by locking system means, the locking system means being slidably mounted in the support means and floor contacting foot means pivotally mounted on the prop means. The improvement provides the prop means having a lower end pivotally mounting foot means, the foot means having floor contacting base means and paired opposed side walls, the foot means being pivotable between an upper position aligned with the prop means and a lower angled position from about 110° to about 120°, preferably about 110° to about 115°, most preferably about 111°, downward and outward of the upper position. The prop lower end has a surface engaging a surface of the base means in the lower angled position and preventing further outward and downward rotation. The base means may have a floor contacting surface of frictional material. The locking system means can have pivot means, to pivotally mount prop means at an upper end, the upper end being pivotable between a first upper position angled from about 20° to about 30°, preferably about 20° to about 25°, most preferably about 21° outward and downward of the support means and a second position adjacent the support means, the locking system having a surface which engages a surface of the upper end of the prop in the first position preventing further upward and outward rotation.

When in any of the above noted broad aspects the locking system means includes saw tooth means, ratchet means to urge the locking system downward may be provided. The locking system comprises first transverse horizontal ratchet pivot means, and ratchet lever means pivoted thereon, pivotable between first lower vertical and second upper angled and third uppermost angled positions. Second transverse horizontal ratchet pivot means in the ratchet lever means have ratchet arm means pivoted thereon between first noncontacting and second contacting positions. The ratchet arm means has ratchet saw tooth surfaces capable of engaging channel wall saw tooth surfaces. Movement of the ratchet lever means from the first vertical to the second upper position urges the ratchet arm means into the second contacting position and the ratchet saw tooth surfaces into mating contact with the channel wall saw tooth surfaces. Further movement of the ratchet lever means from the second upper to the third uppermost position moves the locking system and the block downward, to engage the locking system and the block lower down the channel wall saw tooth surfaces.

In another broad aspect the invention is directed to a security system kit for mounting to the inner face of a door to engage the floor to prevent the door being opened comprising in combination, support means mountable on the door means, prop means pivotally mounted in the support means by locking system means, the locking system means being slidably mounted in the support means, and floor contacting foot means pivotally mounted on the prop means. The improvement provides the prop means having pivotally upper prop portion means and lower prop portion means, the upper and lower prop portion means being hinged and rotatable about a common axis between first linear position and second angled position. The upper and lower prop portion means each having spaced apart doorward and outer surface means, the doorward surface means contacting each other in the first linear position and the outer surface means contacting each other in the second angled position. First lever means are pivotally mounted in the upper prop portion on the outer side by first lever pivot means. The first lever means has terminal wedge means below the first lever pivot means and control means above the first lever pivot means. The terminal wedge means has upper and lower wedge surface means, and tension spring means connecting the first lever means to the lower prop portion means on the doorward side urging the first lever means toward the lower prop portion means. When the prop portion means are in the first linear position, the upper and lower wedge surface means are urged by the tension spring means into contact with the upper and lower outer surface means respectively, whereby movement of the first lever means toward the upper prop portion means removes the terminal wedge means from contact with the upper and lower outer surface means, the lower prop portion means is urged toward the wedge means and the upper and lower outer surface means are urged into contact, when the prop portions forming the second angled position. Preferably stop lever means are pivoted within the upper prop portion means urged by second spring means into rest position. The stop lever means prevents movement of the first lever means toward the upper prop portion. Second lever means are pivotally mounted in the upper prop portion means. This second lever means when actuated urges the stop lever means from the rest position allowing the first lever means to pivot toward the upper prop portion, further actuation of the second lever means urges the first lever means toward the upper prop portion means. More preferably the second lever means is pivotally mounted in the first lever means. Any release lever is mounted on the upper portion of the prop away from the door as this makes it harder to reach the release lever under the door.

The above described release system can be utilized with any prop of the invention.

It will be realized by those skilled in the art that the above noted broad inventive aspects may be combined in various combinations, without going beyond the spirit and nature of the invention.

Floor plate means having therein aperture means, may be utilized in combination with the foot floor contacting base means including therein similar aperture means, and pin means which matingly fit both said aperture means, to prevent objects thrust under the door from moving the foot.

Preferably the paired opposed side walls of the foot means are of rounded triangular profile to make it difficult for objects thrust under the door to move said foot means.

Bracket means having opposed spaced apart parallel inner and outer face walls may be used to mount the support means on the door. The face walls are spaced a distance apart, so as to receive contactingly a door therebetween. Edge walls connect the opposed face walls, the edge walls being at right angles to each other and to the face walls, so the edge walls may contact adjacent edges of a door. The inner face wall has attachment means for the support means which may be threaded stud means protruding perpendicularly therefrom. The edge walls extend toward each other at least about ¼ inch past an imaginary plane at right angles to each edge wall and passing through the center of the threaded stud. Preferably the edge walls extend toward each other at least ⅜ inch past the imaginary plane.

In use the support is attached to the door, directly by screws and the like, or indirectly by the bracket, the prop is pulled out, the locking system disengaged and it and the prop slid down until the foot engages the floor. The prop may be ratcheted downward to jam the prop and foot hard against the floor. When present the release lever 'breaks' the prop allowing release of the system.

BRIEF DESCRIPTION OF THE DRAWINGS

Preferred embodiments are indicated in the drawings where.

DESCRIPTION OF THE PREFERRED EMBODIMENTS

The general description of the invention is now expanded by reference to the drawings, which illustrate preferred embodiments of the invention.

Figure 1:
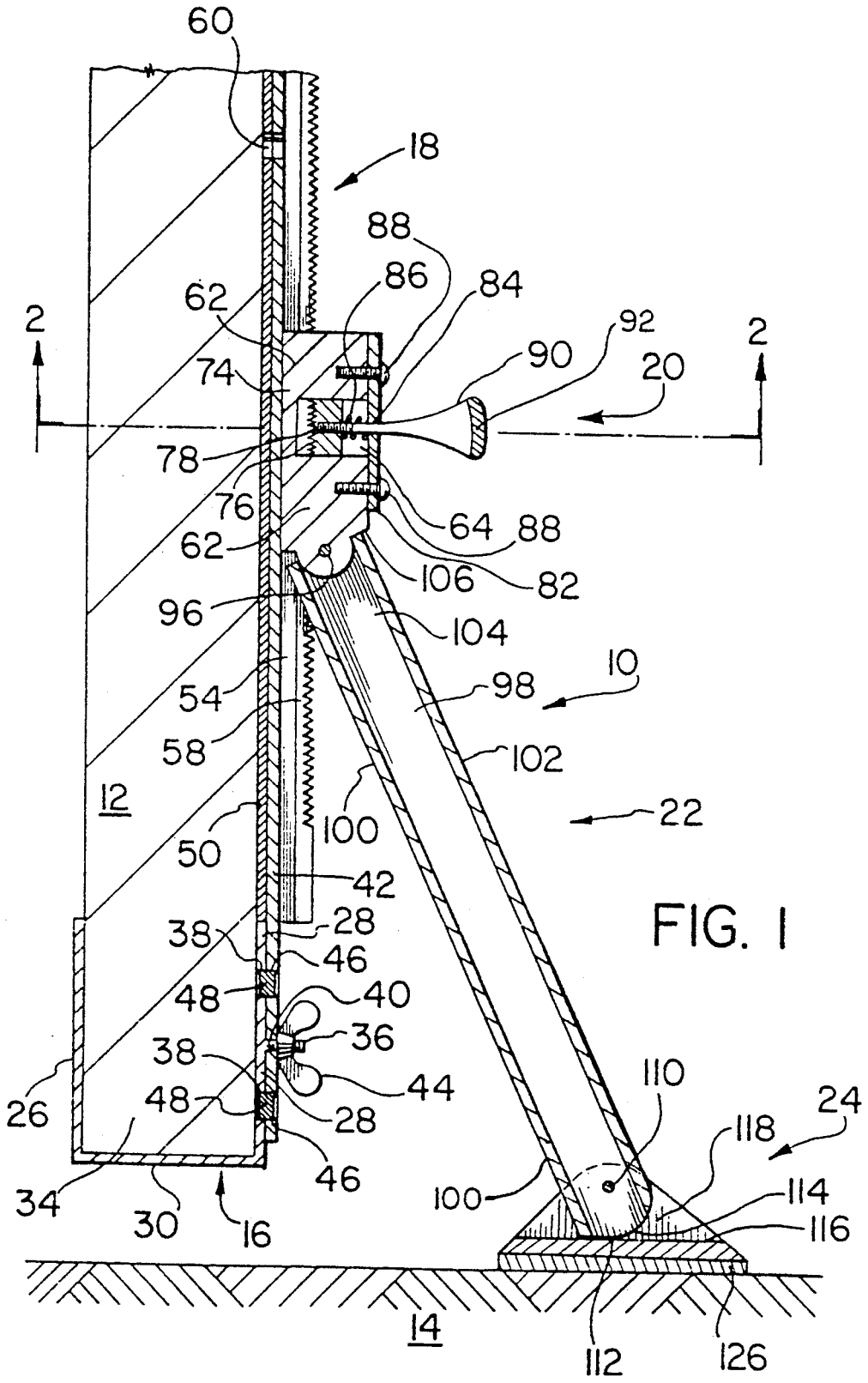
FIG. 1 shows a side sectional view of an embodiment of the invention as attached to a door.
Figure 2:
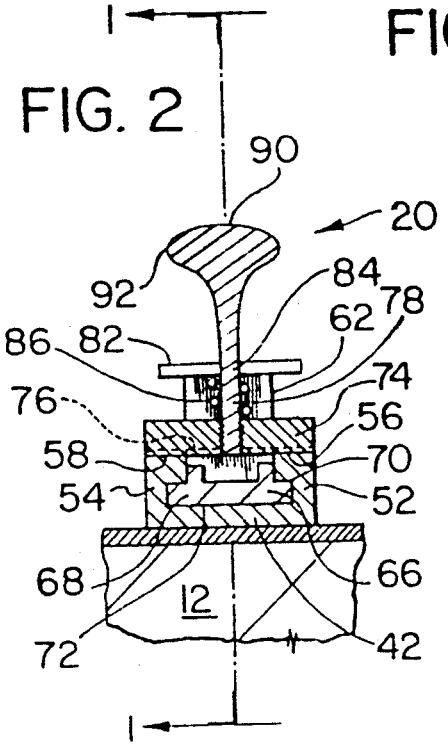
FIG. 2 shows a plan sectional view of the locking system of FIG. 1 as attached to a door.
Figure 3:
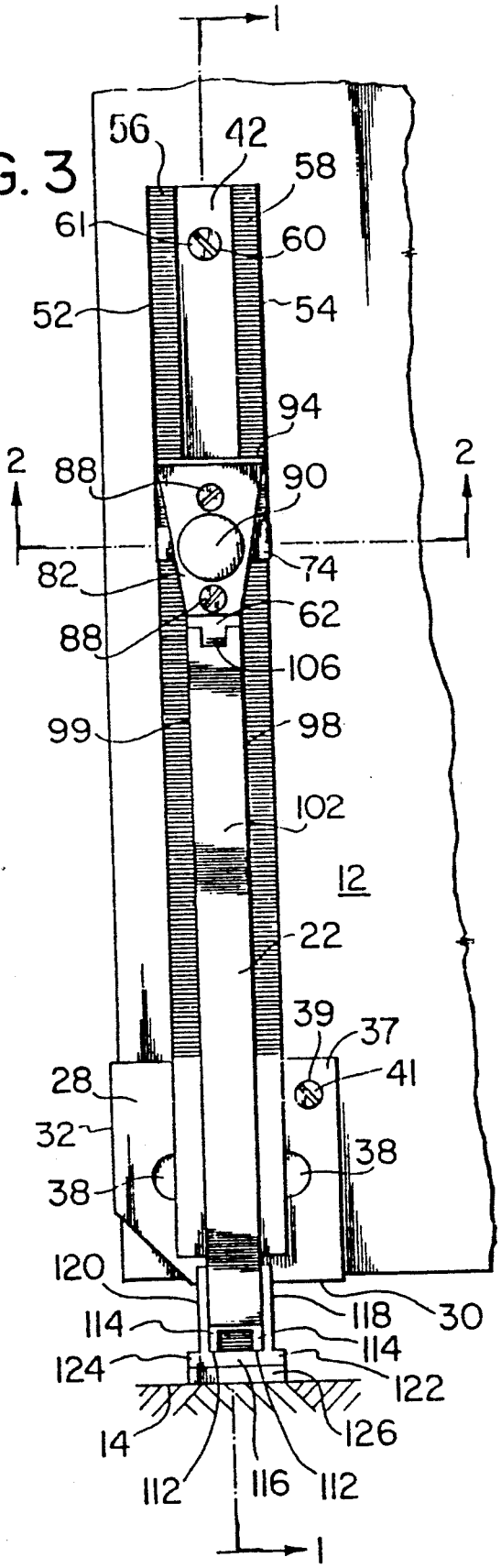
FIG. 3 shows an elevational view of the embodiment of FIG. 1 as attached to a door.
Figure 4:
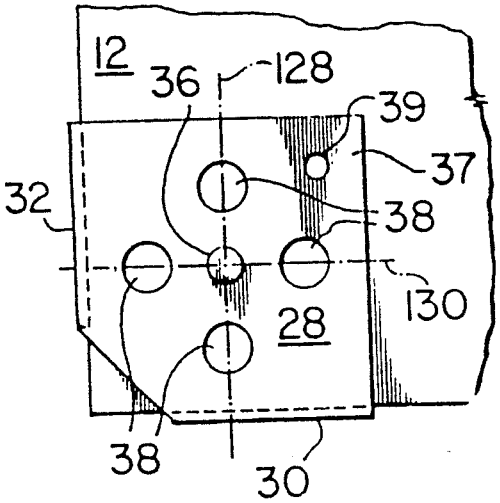
FIG. 4 shows a part sectional view of an embodiment of a bracket of the invention.
Figure 7:
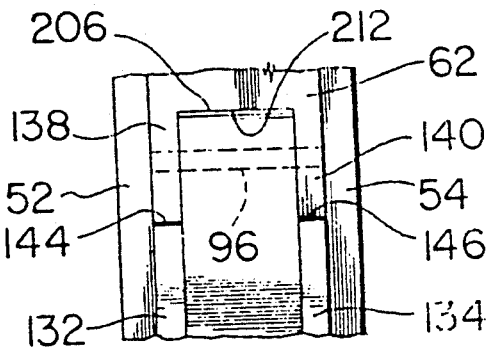
FIG. 7 shows a rear view of the embodiment of FIG. 6.
Figure 5:
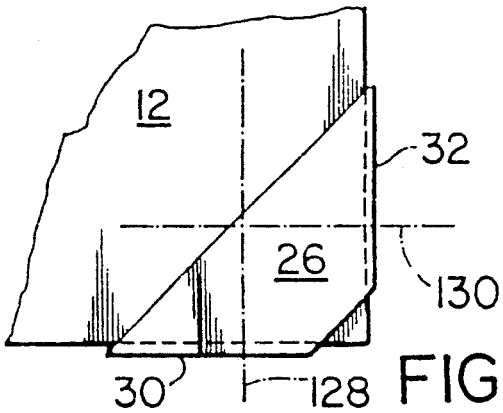
FIG. 5 shows a part sectional view of an embodiment of a bracket of the invention as attached to the outside of a door.
Figure 6:
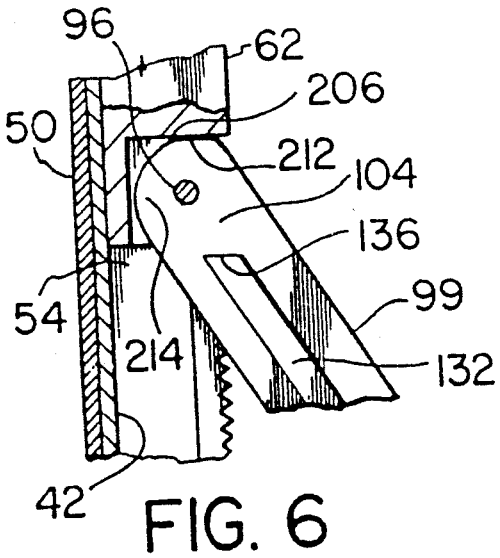
FIG. 6 shows a side part sectional view of an alternative embodiment of prop pivot mounting to that of FIG. 1.
Figure 8:
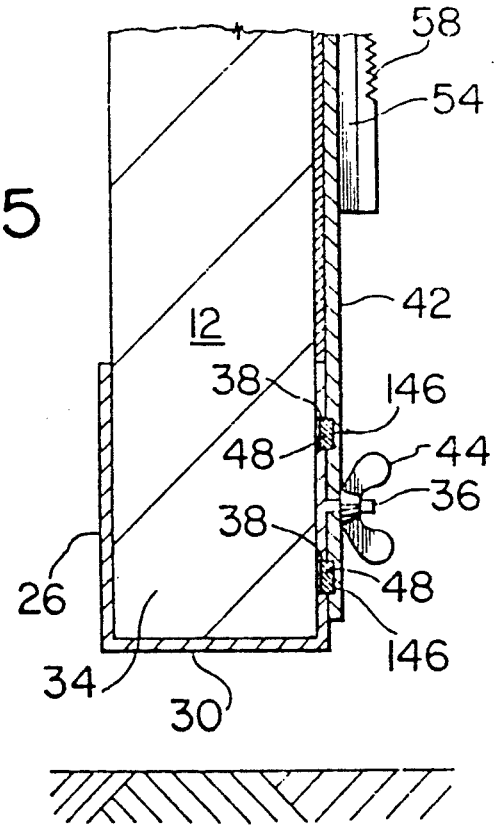
FIG. 8 shows a side sectional view of another embodiment of the lower door support.

Numeral 10 generally indicates the door security system of the invention, this system is attached to door 12 and rests on floor 14. System 10 has door attachment bracket 16, door support 18, locking system 20, prop 22 and foot 24. Bracket 16 includes outer face wall 26, inner face wall 28 and edge walls 30 and 32, forming space 34 into which door 12 fits snugly. Space 34 between face walls 26 and 28 is of a size to snugly receive door 12, typically space 34 is $1\frac{3}{4}$ inch or $1\frac{3}{8}$ inch, but as those skilled in the art would appreciate brackets can be made for any required door thickness. Bracket 16 may conveniently be sheet metal or plastic of suitable engineering strengths. Inner face wall 28 has central threaded stud 36 surrounded by four circular holes 38, two vertically aligned with stud 36 and two horizontally aligned with stud 36. Inner face wall 26 is a modified square. Optionally inner corner 37 may provide hole 39 allowing attachment to the door by attachment means for instance screw 41. Outer face wall 28 is of trapezoid form extending between edge walls 30 and 32, which themselves are rectangular, in use they abut adjoining door edges. Door support 18 is secured to bracket 18 and door 12 by wingnut 44 threaded onto stud 36 which passes through hole 40 in door wall 42 of door support 18. Applicant has found (shown in FIGS. 4 and 5) that edge walls 30 and 32 must extend toward the corner of the door, well past centre lines 128 and 130 passing through stud 36. When pressure is exerted on door 12 and security system 10, and for instance, edge wall 30 does not extend past line 128, bracket 16 tends to slip down off the door. In an original version (not shown) edge wall 30 did not extend to center line 128, it was found necessary to extend edge wall 30 past center line 128, generally $\frac{1}{4}$ inch or more preferably $\frac{3}{8}$ inch extension was found satisfactory. The same extension is necessary on edge wall 32, so as to allow bracket 16 to be used on both right and lefthand lower door corners, this extension is easily routinely determinable by those skilled in the art. Door wall 42 has paired vertical holes 46 which align with vertical holes 38, alignment plugs 48 fixed within holes 46 protrude into holes 34. Above inner face wall 28, door wall 42 has resilient covering 50, to protect the surface of the door, channel walls 52 and 54 extend outward from door wall 42 with sawtooth outer surfaces 56 and 58, sawtooth surfaces of 3/32 inch spacing and 1/16 inch depth, and 1/20 inch spacing and 1/20 inch depth have been successfully utilized, as those skilled in the art would realize these parameters can be routinely varied. Hole 60 at the top end of door wall 42 allows for permanent attachment of door support 18 to door 12, by suitable attachment means, for instance screw 61. Locking system 20 includes housing 62, which has central well 64, and side flanges 66 and 68, which slidably engage grooves 70 and 72 in channel walls 52 and 54. Grooves 70 and 72 and extend the length of channel walls 52 and 54. Locking system 20 is locked in place by block 74, which matingly engages sawtooth surfaces 56 and 58 of door support 18, by its own sawtooth surface 76. Block 74 is threaded diameter shaft 78, which is horizontally aligned in well 64 by plate 82 in which it is slidably received by hole 84, bias spring 86 urges block 74 into mating engagement with sawtooth surfaces 56 and 58. Plate 82, is secured to housing 62 by screws 88. Handle 90 integral with shaft 78 has knurled rim 92, allows the operator to pull shaft 78 away from the door releasing block 74 from mating engagement and allowing locking system 20 to be slid up or down in door support 18. The operator exerts upward or downward pressure on locking system 20, by pushing down. Prop 22 is pivotally mounted in housing 62 by pivot pin 96, and consists of a modified rectangular tube, with side walls 98 and 99, and front wall 100 and rear wall 102. When locking system 20 is pushed down prop 22 rotates until upper end 104 of rear wall 102 contacts surface 106 of housing 62, which may be at any desired angle to the horizontal. Prop 22 is at the same angle to the vertical. In practice this angle is desirably between about 20° and about 30°, more preferably about 21°. At lesser angles prop 12 tends to fold against door 12 as it is raised by external pressure. At greater angles the frictional resistance developed by foot 24 may be insufficient to prevent movement of door 12, certainly at a angle of 35° to the vertical or 55° to the horizontal the foot has a tendency to slip. An alternative prop pivot mounting (FIGS. 6 and 7) has walls 98 and 99 of prop end 104 having flat end segment 212 adjoining arcuate end segment 214, at the desired angle segment 212 meets horizontal surface 206 of housing 62. Prop 22 has optional side ribs 132, 134 terminating in flat surfaces 136 and 138, parallel to flat end segment 212. At the desired angle surfaces 136 and 138, meet side walls 140 and 142 of housing 62, in which is mounted pivot pin 96 (shown in ghost), along surfaces 144 and 146. Lower end 108 of prop 22 is pivotally mounted in foot 24 by pin 110. Walls 98 and 99 of end 108 have a specific shape flat segment 112 adjoining arcuate segment 114. Flat segment 112 is desirably at an angle of about 60° to about 70° to wall 100, and more preferably about 69°. Flat segment 112 contacts base 116 of foot 24. Foot 24 has rounded triangular walls 118 and 120 and angled flanges 122 and 124, which allows objects slid through any gap will has less tendency to go underneath foot 24.

Figure 9:
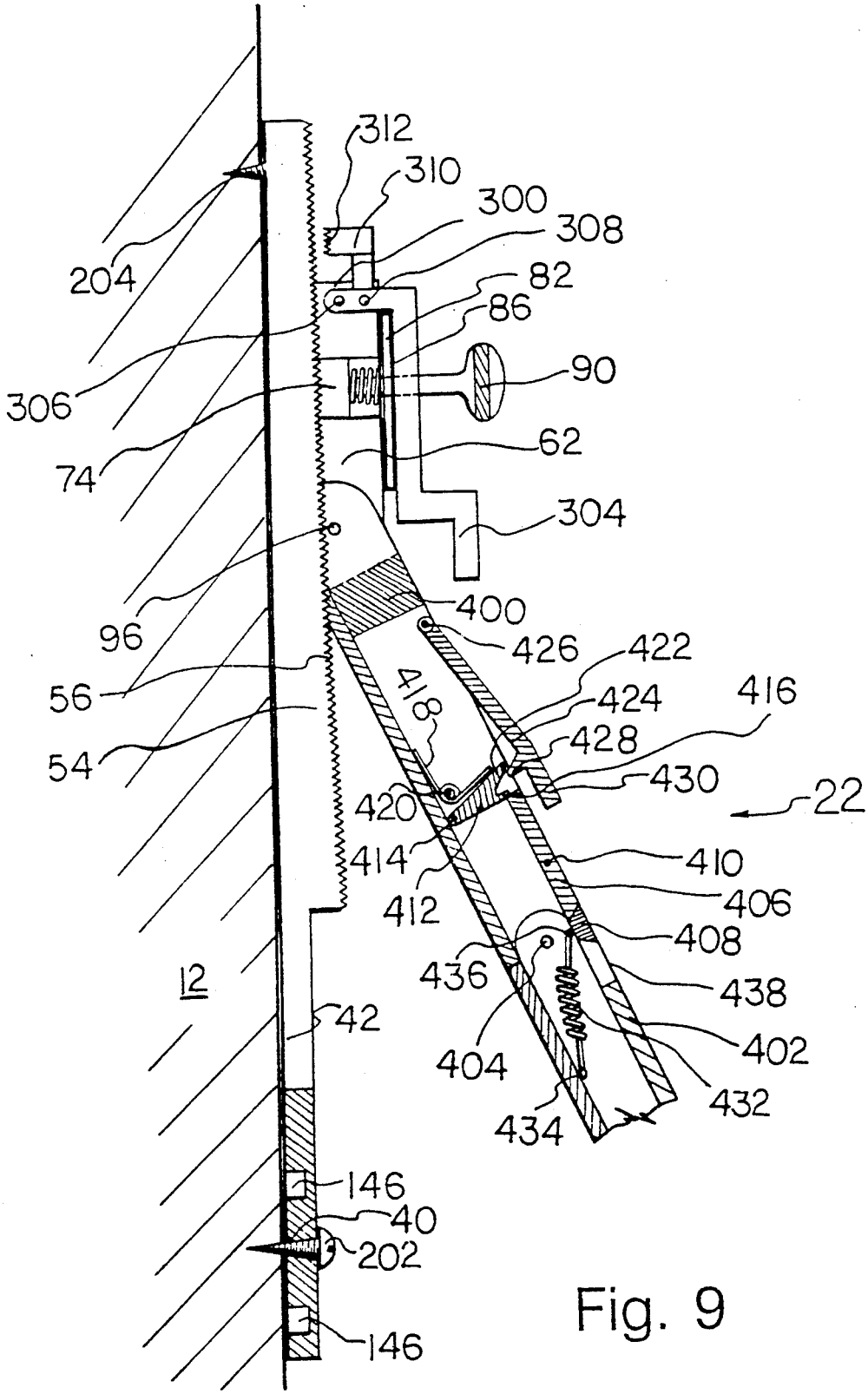
FIG. 9 shows a part sectional view of another embodiment of the invention.
Figure 10:
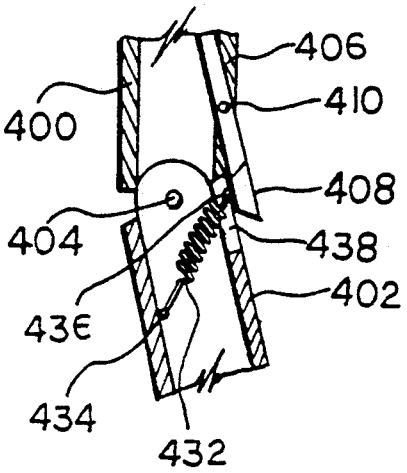
FIG. 10 shows a part sectional view of a detail of the embodiment of FIG. 9 in different position.
Figure 11:
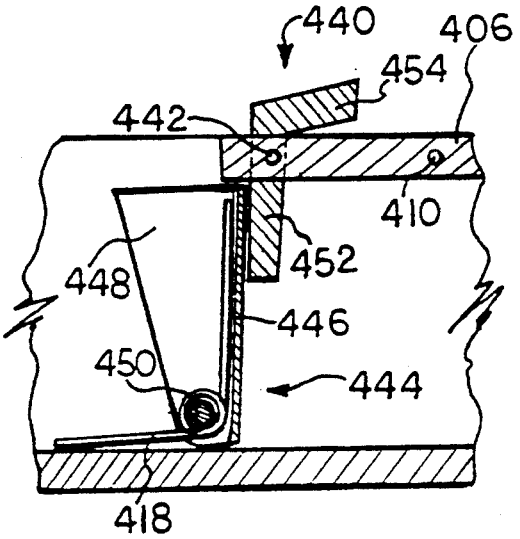
FIG. 11 shows a part sectional view of an alternative embodiment to that of FIG. 10.
Figure 12:
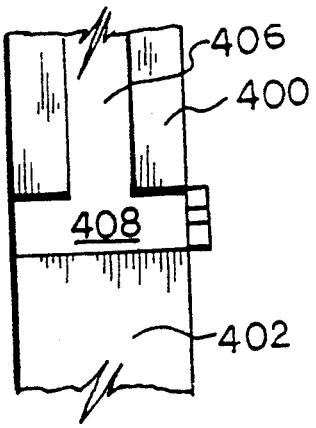
FIG. 12 shows a rear view of a detail of the embodiments of FIGS. 9, 10, and 11.
Figure 13:
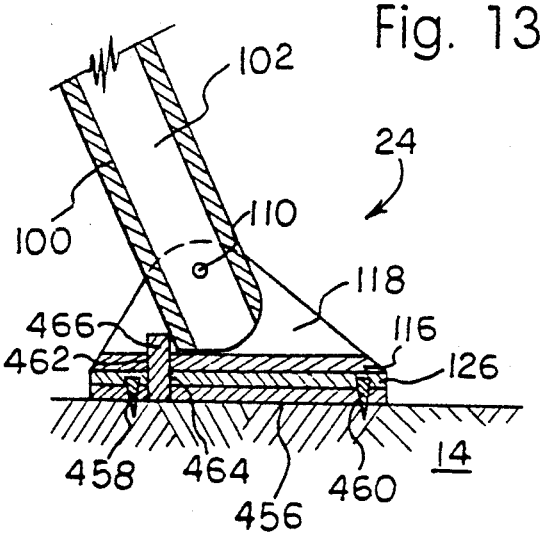
FIG. 13 shows a sectional view of an additional embodiment of the invention.

Alternative embodiment (FIG. 9) shows wells 146 in door wall 42 containing plugs 48 engaging bracket apertures 38, with channel wall 54 starting further up door wall 42, which is fixedly attached to door 12 by screws 202 and 204, through holes 40 and 60 (not shown). Housing 62 has upward extension 300 between channel walls 52 and 54, which mounts ratchet lever 304 on pivot pin 306, pivot pin 308 mounts ratchet member 310, which has sawtooth surface 312 to engage sawtooth surfaces 56 and 58. When lever 304 is raised it moves pivot pin 308 upward and inward so surface 312 engages surfaces 56 and 58, forcing housing 62 and block 74 downwards, this is repeated until foot 24 is in tight engagement with floor 14. Prop 22 has upper 400 and lower 402 portions pivoted at pivot pin 404, locking lever 406 has locking wedge 408 which holds prop 22 rigid. Locking lever 406 is pivoted about pivot pin 410, locking lever 406 is held in position by U shaped metal holding lever 412, which is itself pivoted about pivot pin 414, lower arm 416 of holding lever 412 engages locking lever 406 preventing movement of locking lever 406, spring 418, around pivot pin 420 urges upper arm 422 of lever 412 downward. Release lever 424 is pivoted about pivot pin 426, and has wedge 428 and extension 430. On actuation of lever 426, wedge 428 engages upper arm 422 of U lever 412 forcing it upward and disengaging lower arm 416 of U lever 412 from locking lever 406. Extension 430 then contacts locking lever 406 rotating it inward and downward, and locking wedge 408 outward and upward, spring 432 secured to wedge 408 by pin or screw 438 and to lower portion 402 of prop 434 by screw 436 urges portion 402 upward spring 432 is accommodated within slot 438 as shown in FIG. 10. In FIG. 11, is shown a variation on the release lever mechanism, here U lever 412 is replaced by support 444 pivoted about pivot pin 450, it has transverse wall 466 which prevents lever 406 moving and side walls 448, spring 418 similarly mounted about pivot pin 450 urges support 444 downward to contact release lever 440's inside arm 452. To release the operator pushes in arm 454 which pushes arm 452 against support 444 pivoting it away from lever 406, further pressure on arm 454 pushes lever 406 with prop 22 and releases locking wedge 408 as in FIG. 10. The position of locking wedge 408 is shown in FIG. 12.

Floor plate 456 secured directly to floor 14 by screws or nails 458 and 460, may be used in combination with foot 24, when holes 462 in base 116, and 464 in floor plate 456, engage register pin 466 therein, pin 466 may be threaded in hole 462, which makes it difficult to dislodge foot 24.

The dimensions used in the device are indicated as an illustrative guide and not as limitations. The door bracket has an inner face wall approximately 2 inches square. The door support is about 9½ inches long 1 inch across with the channel extending 5¾ to 7½ inches, and sawtooth surfaces extending 4½ to 7½ inches along the channel. The channel walls are 7/16 inch deep, with the channel itself being ½ inch wide and 5/16 inch deep, and having grooves ⅛ inch by ⅛ inch. The lock system housing fits slidably into the channel, and is about 2 inches long, with a central well approximately ½ inch square. The prop is 7 inches long, ¾ inch deep and ½ or ⅝ inch wide, it may be solid, but is preferably hollow with ⅛ inch thick walls. The foot is 1¾ inch long, and 1 inch wide, ⅞ inch deep with rectangular sidewalls or ¾ inch deep with triangular sidewalls. The foot walls are ⅛ inch thick.

In use the operator fits bracket 16 onto the corner of the door. Rest of the system 10 is then attached by wingnut 44, and locking system 20 slid down, by pulling block 74 away from surfaces 56 and 58 using handle 90, prop 22 is swung out until wall 102 contacts surface 106 at the desired angle and foot 24 engages floor 14, with surface 112 contacting floor wall 116, at this point operator releases the handle and block 74 matingly engages surfaces 56 and 58. Downward pressure is exerted on housing 62, or by using ratchet lever 304, so foot 24 tightly engages floor 14. If the operator wishes to open the door handle 90 is used to disengage block 74, locking system 20 (with prop 22 and foot 24) is raised slightly, allowing the door to be opened. Alternatively channel 18 is attached directly to the door, without use of bracket 16, and the operator proceeds as before. The door may be opened a slit and locking system 20 moved down for foot 24 to engage floor 14. When release lever 424 or 454 is present it is actuated and prop 22 bends or 'breaks' in the middle thus removing foot 24 from floor contact. Applicant has found device 10 extremely effective, force exerted against the door raises it into the lintel, without significant displacement of foot 24.

By way of illustration but not of limitation, the bracket is conveniently made from sheet metal, while the rest of the kit is generally made from aluminum. Those skilled in the art can routinely determine suitable materials to use in the device, which as indicated include plastics of suitable engineering strengths.

As those skilled in the art would realize these preferred illustrated dimensions, details and components can be subjected to substantial variation, modification, change, alteration, and substitution without affecting or modifying the function of the illustrated embodiments.

This invention is not limited to the embodiments described above, and it will be apparent to persons skilled in the art that numerous modifications and variations form part of the present invention insofar as they do not depart from the spirit, nature and scope of the claimed and described invention.

I claim:

1. In a security system kit for mounting to the inner face of a door to engage the floor to prevent the door being opened comprising in combination:

support means mountable on said door means, prop means pivotally mounted in said support means by locking system means, and floor contacting foot means pivotally mounted on said prop means, the improvement wherein said support means comprises base wall means for mounting to the inner face of a door, and said support means includes channel means extending upward when said base wall means is mounted on a door, said channel means including paired spaced apart opposed channel walls having facing longitudinally extending grooves therein, said locking system means includes slide means slidably mounted in said channel means, said slide means having side flanges slidably received in said grooves, said slide means mounting releasable locking means, said channel means further including receiving means for mating engagement of said locking means, extending longitudinally of said channel means.

2. In a security system kit for mounting to the inner face of a door to engage the floor to prevent the door being opened comprising in combination:

support means mountable on said door means, prop means pivotally mounted in said support means by locking system means, said locking system means being slidably mounted in said support means, and floor contacting foot means pivotally mounted on said prop means, the improvement comprising said prop means having a lower end pivotally mounting foot means, said foot means having floor contacting base means and paired opposed side walls, said foot means being pivotable between an upper position aligned with said prop means and a lower angled position from about 110° to about 120°, downward and outward of said upper position, said prop lower end having a surface engaging a surface of said base means in said lower angled position and preventing further outward and downward rotation.

3. The structure as defined in claim 1, wherein each said channel wall has saw tooth surfaces extending longitudinally of said walls, facing away from said door when said support means is mounted thereon, and well means within said slide means has opposed inner and outer walls, said outer wall having an aperture, shaft means slidably mounted in said aperture, block means having saw tooth surface means mounted on said shaft means, spring means in said well means in contact with said block means and said outer wall urging said saw tooth surface means into mating engagement with said saw tooth surfaces of said channel walls, handle means attached to said shaft means, enabling disengagement of said block means.

4. The structure as defined in claim 3, wherein said base wall means includes first lower base aperture means and second upper aperture means allowing said base wall means to be fixed attached to said door means.

5. The structure as defined in claim 1, comprising said prop means having a lower end pivotally mounting foot means, said foot means having floor contacting base means and paired opposed side walls, said foot means being pivotable between an upper position aligned with said prop means and a lower angled position from about 110° to about 120° downward and outward of said upper position, said prop lower end having a surface engaging a surface of said base means in said lower angled position and preventing further outward and downward rotation.

6. The structure as defined in claim 5, wherein said locking system means has pivot means, to pivotally mount prop means at an upper end, said upper end being pivotable between a first upper position angled from about 20° to about 30° outward and downward of said support means and a second position adjacent said support means, said slide means having a surface which engages a surface of said upper end of said prop in said first position preventing further upward and outward rotation.

7. The structure as defined in claim 6, wherein said lower angled position of said foot means is about 111° downward and outward of said upper position, said first upper position is angled about 21° outward and downward of said support means, and said base means has a floor contacting surface of frictional material.

8. The structure as defined in claim 2, wherein said locking system means has pivot means, to pivotally mount prop means at an upper end, said upper end being pivotable between a first upper position angled from about 20° to about 30° outward and downward of said support means and a second position adjacent said support means, said slide means having a surface which engages a surface of said upper end of said prop in said first position preventing further upward and outward rotation.

9. The structure as defined in claim 8, wherein said lower angled position of said foot means is about 111° downward and outward of said upper position, said first upper position is angled about 21° outward and downward of said support means, and said base means has a floor contacting surface of frictional material.

10. The structure as defined in claim 3 wherein said locking system comprises first transverse horizontal ratchet pivot means, ratchet lever means pivoted thereon, said ratchet lever being pivotable between first lower vertical and second upper angled and third uppermost angled positions, second transverse horizontal ratchet pivot means in said ratchet lever means, ratchet arm means pivoted on said second ratchet pivot means between first noncontacting and second contacting positions, said ratchet arm means having ratchet saw tooth surfaces capable of engaging channel wall saw tooth surfaces, movement of said ratchet lever means from said first vertical to said second upper position urging said ratchet arm means into said second contacting position and said ratchet saw tooth surfaces into mating contact with said channel wall saw tooth surfaces, movement of said ratchet lever means from said second upper to said third uppermost position moving said locking system and said block downward, to engage said locking system and said block lower down said channel wall saw tooth surfaces.

11. In a security system kit for mounting to the inner face of a door to engage the floor to prevent the door being opened comprising in combination:

support means mountable on said door means, prop means pivotally mounted in said support means by locking system means, said locking system means being slidably mounted in said support means, and floor contacting foot means pivotally mounted on said prop means, the improvement comprising said prop means having pivotally upper prop portion means and lower prop portion means, said upper and lower prop portion means being hinged and rotatable about a common axis between first linear position and second angled position, said upper and lower prop portion means each having spaced apart doorward and outer surface means, said doorward surface means contacting each other in said first linear position and said outer surface means contacting each other in said second angled position, first lever means pivotally mounted in said upper prop portion on the outer side by first lever pivot means, said first lever means having terminal wedge means below said first lever pivot means and control means above said first lever pivot means, said terminal wedge means having upper and lower wedge surface means, and tension spring means connecting said first lever means to said lower prop portion means on the doorward side urging said first lever means toward said lower prop portion means, when said prop portion means are in said first linear position, said upper and lower wedge surface means are urged by said tension spring means into contact with said upper and lower outer surface means respectively, whereby movement of said first lever means toward said upper prop portion means removes said terminal wedge means from contact with said upper and lower outer surface means, said lower prop portion means is urged toward said wedge means and said upper and lower outer surface means are urged into contact, said prop portions forming said second angled position.

12. The structure of claim 11, wherein stop lever means are pivoted within said upper prop portion means urged by second spring means into rest position, said stop lever means preventing movement of said first lever means toward said upper prop portion, second lever means pivotally mounted in said upper prop portion means, said second lever means when actuated urging said stop lever means from said rest position allowing said first lever means to pivot toward said upper prop portion, further actuation of said second lever means urging said first lever means toward said upper prop portion means.

13. The structure of claim 12, wherein said second lever means is pivotally mounted in said first lever means.

14. The structure as defined in claim 1 said locking system means has pivot means, to pivotally mount prop means at an upper end, said upper end being pivotable between a first upper position angled from about 20° to about 30° outward and downward of said support means and a second position adjacent said support means, said locking system means having a surface which engages a surface of said upper end of said prop in said first position preventing further upward and outward rotation.

15. The structure as defined in claim 14, wherein said lower angled position of said foot means is about 111° downward and outward of said upper position, said first upper position is angled about 21° outward and downward of said support means, and said base means has a floor contacting surface of frictional material.

16. The structure as defined in claim 2, additionally comprising floor plate means having therein aperture means, said floor contacting base means including therein similar aperture means, pin means which matingly fit both said aperture means.

17. The structure as defined in claim 2, wherein said paired opposed side walls are of rounded triangular profile to make it difficult for objects thrust under the door to move said foot means.

18. The structure as defined in claim 16, wherein said paired opposed side walls are of rounded triangular profile to make it difficult for objects thrust under the door to move said foot means.

19. The structure of claim 10 comprising bracket means attachable to said door, having opposed spaced apart parallel inner and outer face walls, said face walls being spaced a distance apart, so as to receive contactingly a door therebetween, edge walls connecting said opposed face walls, said edge walls being at right angles to each other and to said face walls, so said edge walls may contact adjacent edges of a door, said inner face wall having attachment means mounted thereon to mount said support means thereon, said edge walls extending toward each other at least about ¼ inch past an imaginary plane at right angles to each said edge wall and passing through the center of said support means.

20. The structure of claim 11 comprising bracket means attachable to said door, having opposed spaced apart parallel inner and outer face walls, said face walls being spaced a distance apart, so as to receive contactingly a door therebetween, edge walls connecting said opposed face walls, said edge walls being at right angles to each other and to said face walls, so said edge walls may contact adjacent edges of a door, said inner face wall having attachment means mounted thereon to mount said support means thereon, said edge walls extending toward each other at least about ¼ inch past an imaginary plane at right angles to each said edge wall and passing through the center of said support means.

* * * * *